US005078620A

United States Patent [19]

Verhoeven

[11] Patent Number: 5,078,620

[45] Date of Patent: Jan. 7, 1992

[54] CONNECTOR ASSEMBLY FOR COAXIAL CABLE

[75] Inventor: Laurentius M. Verhoeven, Veghel, Netherlands

[73] Assignee: E. I. Du Pont de Nemours and Company, Wilmington, Del.

[21] Appl. No.: 684,131

[22] Filed: Apr. 11, 1991

Related U.S. Application Data

[63] Continuation of Ser. No. 615,910, Nov. 20, 1990, abandoned.

[30] Foreign Application Priority Data

Nov. 20, 1989 [NL] Netherlands ..... 8902862

[51] Int. Cl.[5] ..... H01R 9/05

[52] U.S. Cl. ..... 439/578; 439/687

[58] Field of Search ..... 439/578-585, 439/686-690, 792

[56] References Cited

U.S. PATENT DOCUMENTS

| | | | |
|---|---|---|---|
| 3,548,365 | 12/1970 | Barker | 439/581 |
| 3,745,509 | 7/1973 | Woodward et al. | 339/14 R |
| 3,745,509 | 7/1973 | Woodland et al. | 439/76 |
| 3,936,132 | 2/1976 | Hutter | 439/578 |
| 3,958,852 | 5/1976 | Abraham et al. | 439/578 |
| 4,184,731 | 1/1980 | Betzmeir | 339/45 M |
| 4,602,831 | 7/1986 | Lockard | 339/14 R |
| 4,790,775 | 12/1988 | David | 439/579 |
| 4,957,456 | 9/1990 | Olson et al. | 439/578 |

FOREIGN PATENT DOCUMENTS

| | | | |
|---|---|---|---|
| 0311041 | 4/1989 | European Pat. Off. | 439/579 |
| 3733070 | 4/1989 | Fed. Rep. of Germany | 439/579 |
| 1520566 | 8/1978 | United Kingdom . | |
| 8703144 | 5/1987 | World Int. Prop. O. . | |

*Primary Examiner*—Larry I. Schwartz
*Assistant Examiner*—Hien D. Vu

[57] ABSTRACT

A connector assembly having multiple parts and means for making contact by clamping between a central conductor of a cable and a contact strip in the connector assembly. Both the contact and conductor may be disposed lying adjacent to each other. One of the connector parts is provided with at least one projection at the overlap between the contact strip and the conductor. Another of the connector parts is provided with at least one recess at the point of overlap between the contact strip and the conductor. The recess is bridged by either the contact strip or the conductor such that in the assembled state the projection lies essentially in the center opposite said recess.

3 Claims, 2 Drawing Sheets

CONNECTOR ASSEMBLY FOR COAXIAL CABLE

This application is a continuation of application Ser. No. 07/615,910 filed Nov. 20, 1990 now abandoned.

BACKGROUND OF THE INVENTION

The invention relates to an electrical connector and in particular to a cable connector which electrically contacts the conductors in a cable through clamping.

U.S. Pat. No. 3,745,509 describes a cable connector wherein the central conductor of a coaxial cable is placed against a projecting part of the connector and another connector part is then secured thereto by screws or the like. Through the pressure exerted by the screws, contact is produced both between the central conductor and a contact strip in the connector and between the conducting sheath of the cable and a secured contact strip in the connector.

In practice, this type of cable connector has proven to be satisfactory only in optimum static conditions, i.e., when the cable is not subject to strain and in the absence of corrosive conditions. A problem that occurs otherwise is that the contact pressure applied by the screws, for example, becomes inadequate after a longer period so that the passage of current between conductor and contact strip is no longer optimum.

SUMMARY OF THE INVENTION

The object of the present invention is to avoid the above disadvantages of the prior art.

This object is achieved through a connector assembly comprising of three parts. One of the connector parts is provided with at least one recess at the point of overlap between a contact strip and a cable conductor, the recess being bridged by either the contact strip or the conductor. In the assembled state, a projection lies essentially in the center opposite the recess. Due to the fact that either the conductor or the contact strip lies on at least two bearing points and either the contact strip or the conductor is engaged by a projection engaging opposite the bearing points, an elastic, resilient pretension is provided in the conductor and contact strip connection when the connector parts are secured relative to each other. Even in dynamic conditions and in corrosive environments this elastic, resilient pretension is sufficient to provide optimum current passage.

According to an advantageous embodiment of the invention, the connector has a base part for accommodating the contact strip(s), an insertion part to be fitted at one side of the contact strip(s), and a shut-off or clamping part to be fitted at the other side thereof. This design is particularly advantageous because such connector parts can be produced with relatively simple mold devices. It is also possible to adapt existing mold parts, designed for solder connections, with slight modifications for the use of a clamping connection.

According to an advantageous embodiment in which the cable has a central conductor, surrounded by an insulating material, both connector parts are provided with a recess for accommodating in a close fit a part of both the conductor and the insulating material. The transition between the recesses is made conical in shape. Inserting the cable so far that the cut-off end of insulating material lies against the conical transition part means that a self-centering effect of the central conductor is provided.

According to another advantageous embodiment, the connector parts are provided with hook means engaging the cable. These serve as a pull relief.

If the cable is a coaxial cable, the connector is preferably provided with a contact strip for contact with the conducting sheath of the cable.

The invention will be explained below in greater detail with reference to an example of an embodiment shown in the drawings.

DETAILED DESCRIPTION OF THE PREFERRED EMBODIMENT

Figure 1:
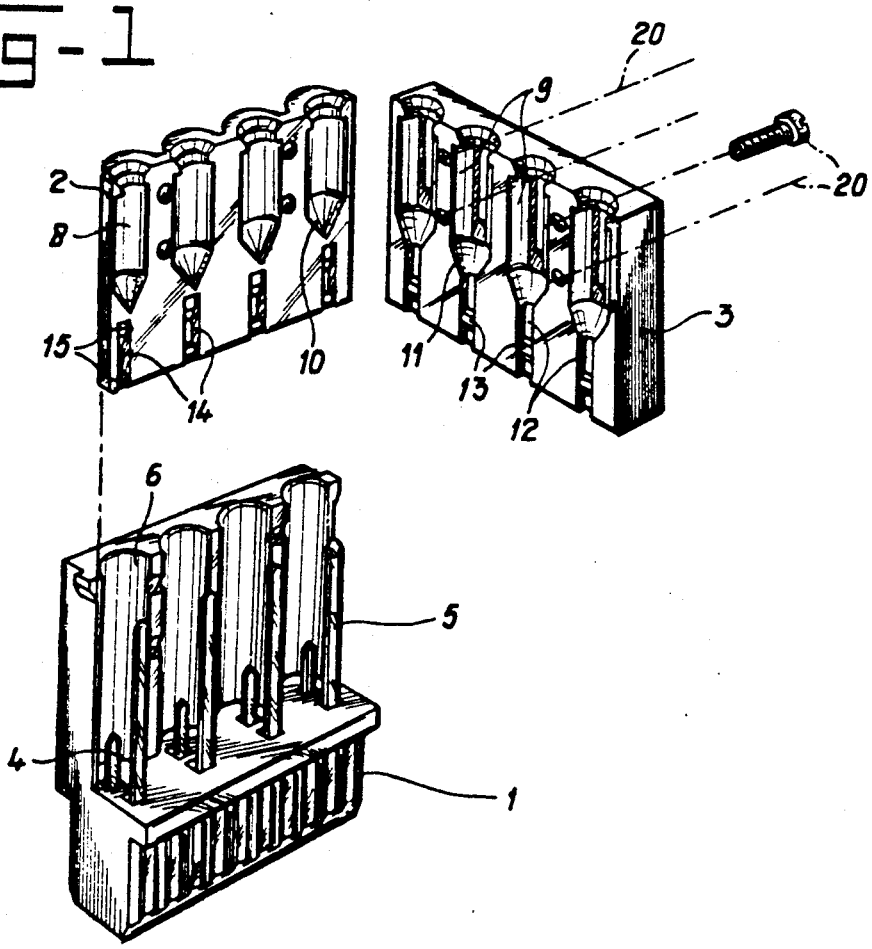
FIG. 1 shows the connector assembly according to the invention in a exploded view.

FIG. 1 shows a cable connector comprising three parts. The first is a connector block 1 formed of insulating material and having a row of contact strips 4 and a row of contact strips 5 disposed therein. The connector block 1 has a plurality of recesses 6 within or adjacent to each is disposed one contact strip 4 and one contact strip 5.

The second connector part is an insertion block 2, also formed of insulating material, which is shaped so as to fit into recesses 6 of the connector block 1. The third connector part is a clamping block 3, also of insulating material, which is screwed to the connector block 1.

Figure 2:
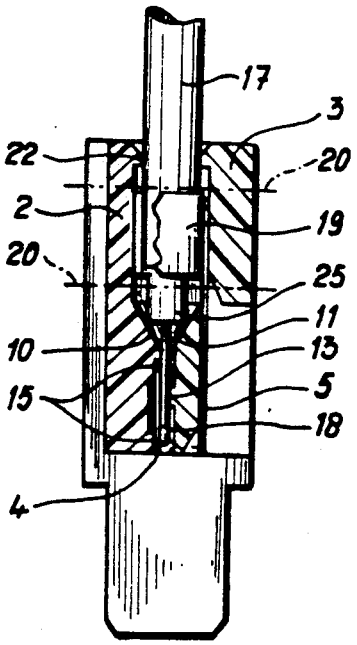
FIG. 2 shows the connector assembly according to the invention assembled with a cable, in cross-section.
Figure 3:
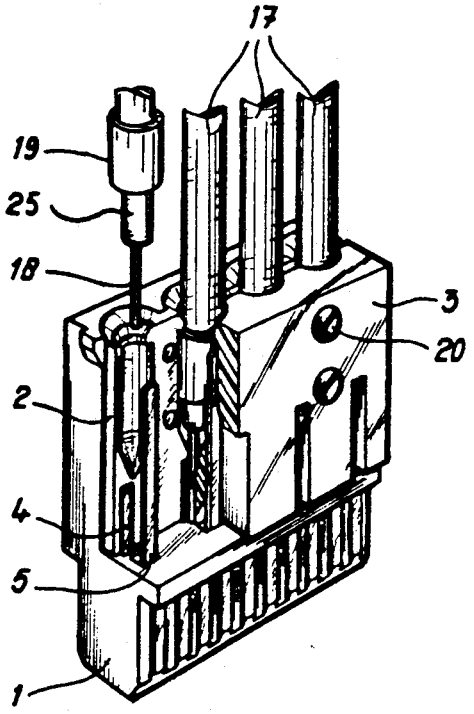
FIG. 3 shows the connector assembly according to the invention during assembly, partially exploded.
Figure 4:
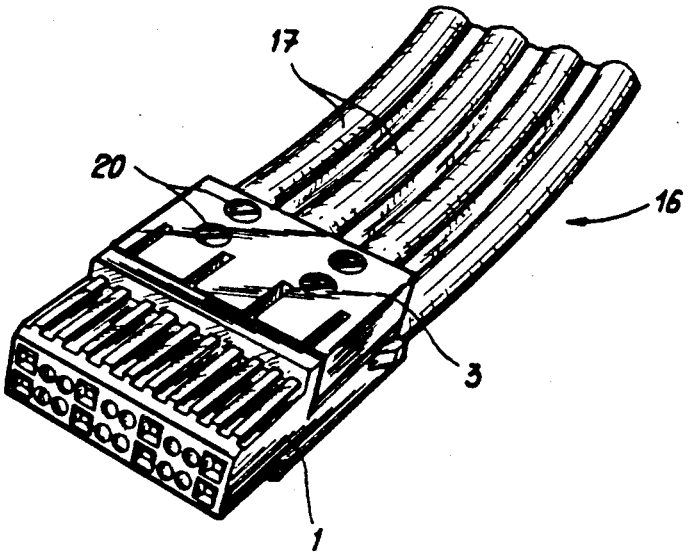
FIG. 4 shows the connector assembly according to the invention connected to a number of cables after assembly.

A coaxial connector such as 17 shown in FIGS. 2–4 is typically accommodated within a cable connector by soldering its conducting sheath to a contact strip such as 5 while the central conductor is soldered to a contact strip such as 4. Such soldering, however, is very time consuming and, with increasing miniaturization, has become increasingly difficult.

According to the present invention, provision is made for fitting the insertion block 2 into the connector block. The outer surface of the insertion block 2 is shaped so as to fit into the recesses 6 of the connector block 1. The insertion block 2 is itself provided with recesses 8. These recesses correspond to the external dimensions of the thickest part of the cable 17 which is to be inserted.

The position of the insertion block 2 after insertion into the connector block 1 can best be seen in the exploded view of FIG. 3. The insert block 2 fills the space within the recesses 6 of the connector block so that contact strips 4 and 5 now are within or adjacent to each recess of the insert block 2.

The insertion block 2 is used essentially to permit production of the connector assembly in a simple manner by injection molding. Problem with removal can thus be avoided. Also, it is possible to use existing molds which had been intended for connector blocks with soldered connections.

The insertion block 2 also has a recess or aperture 14 with two bearing points 15 therein aligned under each recess 8. The space between the bearing points 15 is deeper. As seen from FIGS. 2 and 3, after insertion of the insert block 2, each contact strip 4 will lie within an aperture 14 and rest on or about against the bearing points 15.

The clamping block 3 is also provided with recesses 9 for accommodating the insulation surrounding the cable conductors. Both recesses 8 of the insert block 2 and recess 9 of the clamping block 3 are tapered at their inner or bottom ends to form matching conically shaped portions, 10 and 11, respectively. Conically shaped portions 11 of recesses 9 merge at their lower ends into channels 12 corresponding in size approximately to that of a bare central conductor 18 of cable 17. A lobe or projection 13 is provided in each channel 12.

The cable connector can accommodate a cable 16 (see FIG. 4) which comprises a number of coaxial cables 17. Each coaxial cable has a central conductor 18 at its center and a conducting sheath 19 turned back at its terminated end portion.

As mentioned above, the insert block 2 is first inserted into the connector block 1. The clamping block 3 is then loosely placed in the assembly and the coaxial cable 16 is inserted. The clamping block 3 can be pressed further against the connector block 1 by tightening screws 20.

During tightening, the curved upper edges 22 of the recesses 8 and 9 project radially inward to act as hooks to grip the cable 17 and thus provide strain relief. The turned-back part 19 of the conductive sheath then comes into contact with contact strip 5. The turned-back sheath produces a certain resilient effect.

The conical space provided by conically shaped parts 11 of the clamping block 3 and 10 of the insertion block 2 accommodates and centers the insulating part 25 of the coaxial cable 17 which projects from the turned-back conductive sheath 19. The bare central conductor 18 is thereby accurately placed within the channel 12 provided for it adjacent the contact strip 4.

Through securing and tightening of the clamping block 3, lobe 13 will act on the conductor 18 which in turn is forced against the contact 4 which rests on bearing points 15. A slight bend will be achieved in the process so that a permanent elastic connection is provided between the central conductor 18 and contact strip 4.

FIG. 4 shows the connector after assembly. It does not differ in apperarance in any way from conventional connectors.

Although the embodiment described above is a preferred embodiment, it must be understood that numerous modifications can be made to it without going beyond the scope of the present application. For instance, the connector can be used for a single cable, which is not a coaxial cable. It is also possible for the connection between clamping block and connector to be made in a manner other than with screws.

I claim:

1. A connector assembly for making electrical contact to a coaxial cable having a central conductor surrounded by a first inner insulation layer, a conductive sheath surrounding said first insulation layer and a second outer insulation layer surrounding the conductive sheath, said assembly comprising:

a connector block of insulating material having a plurality of recesses with a pair of electrical contacts extending adjacent each said recess, an insertion block of insulating material shaped so as to be inserted to fit adjacent said recess of the connector block, said insertion block having recesses corresponding to those of the connector block, the insertion block recesses having a curved upper end for receiving a coaxial cable and a conically tapered lower end, said insertion block having a aperture under each of its recesses;

a clamping block of insulating material which is adapted to be secured to said connector block, the clamping block having a plurality of recesses corresponding to those of the insertion block, said clamping block recesses also having a curved upper end for receiving a coaxial cable and a conically tapered lower end, each said lower end merging into a channel for receiving the central conductor of the coaxial cable, said recesses of the insertion block being alignable with the recesses of the clamping block and said channels of said clamping block being alignable with respective apertures under each recess of said insertion block; and whereby when a coaxial cable is inserted into the connector assembly, one of each pair of electrical contacts of the connector block electrically contacts said conductor sheath and a second of said pair of electrical contacts is disposed in each aperture of the insertion block and is brought into electrically contact with the central conductor disposed in said channel of the clamping block.

2. A connector assembly according to claim 1 wherein each channel of the clamping block has a projection and each aperture of said insertion block has a pair of bearing points, said electrical contact in each aperture abutting against said bearing points and said projection acting against the central conductor of the cable to force it against the electrical contact in the aperture.

3. A connector assembly according to claim 1 wherein the ends of the recesses of the insertion block and clamping block for receiving the cable are curved and have edges extending radically inward so that when the clamping block is tightened to said connector and insertion blocks, said edges act on the outer insulation layer of the coaxial cable to provide strain relief.

* * * * *